United States Patent [19]

Madison

[11] 3,949,854

[45] Apr. 13, 1976

[54] TYPEWRITER CARRIAGE CONSTRUCTION

[75] Inventor: Theodore N. Madison, Windsor, Conn.

[73] Assignee: Litton Business Systems, Inc., New York, N.Y.

[22] Filed: Jan. 27, 1975

[21] Appl. No.: 544,183

Related U.S. Application Data

[62] Division of Ser. No. 333,389, Feb. 16, 1973, Pat. No. 3,876,054.

[52] U.S. Cl. ..... 197/63; 197/70; 197/94; 197/176

[51] Int. Cl.[2] ..... B41J 21/02

[58] Field of Search ..... 197/16, 17, 60, 63, 82, 197/86, 176, 179, 186 R, 84 R, 85, 92, 94, 91, 70

[56] References Cited

UNITED STATES PATENTS

| | | | |
|---|---|---|---|
| 3,554,350 | 1/1971 | Rolph et al. | 197/63 X |
| 3,819,028 | 6/1974 | Drillick | 197/82 |

*Primary Examiner*—Edgar S. Burr
*Assistant Examiner*—B. T. Rader
*Attorney, Agent, or Firm*—Joseph R. Spalla; Arthur Gershman

[57] ABSTRACT

A compact lightweight typewriter carriage having a rail supporting an escapement rack, tab rack and margin rack located relative to carriage supported control elements as to minimize twisting moments relative to its frame support incident to actuation and termination of carriage movement.

3 Claims, 1 Drawing Figure

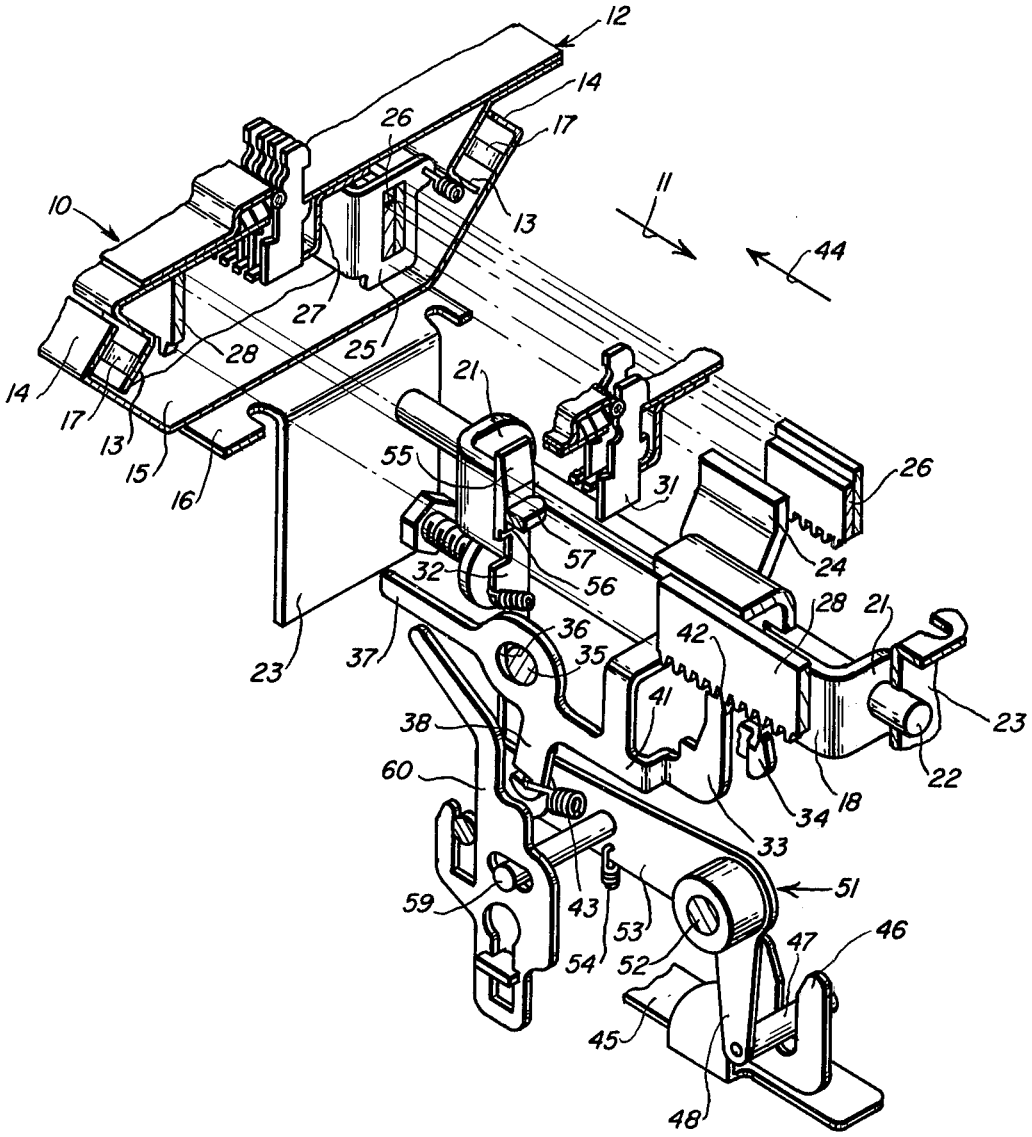
12
14
17
26
13
10
11
44
27
28
25
14
17
13
15
16
21
55
31
26
24
57
56
32
28
21
36
42
35
23
37
41
23
38
22
60
18
34
33
51
59
43
53
54
52
47
46
45
48

TYPEWRITER CARRIAGE CONSTRUCTION

This application is a division of application Ser. No. 333,389, filed Feb. 16, 1973 now U.S. Pat. No. 3,876,054.

This invention relates to a typewriter carriage construction; more particularly, it relates to a typewriter carriage construction wherein escapement, tab and margin racks are supported and arranged relative to carriage control elements to minimize twisting moments incident to carriage movement.

Typewriter carriages of the prior art are generally of massive construction to withstand twisting moments incident to abrupt starting and stopping of the carriage and such massive carriage constructions have required the use of carriage arresting devices to absorb the energy of the moving carriage at the end of long runs.

Accordingly, an object of the invention is to provide a lightweight compact carriage construction which does not require the provision of energy absorbers.

Another object of the invention is in the provision of a carriage which supports escapement, tab and margin racks between the carriage rails.

Still another object of the invention is in the provision of a compact, light and balanced carriage and associated control elements arranged to minimize twisting moments of the carriage incident to initiation and termination of carriage movements.

Other objects, features and advantages of the present invention will become apparent to those skilled in the art from a reading of the following detailed description of a preferred embodiment, taken in conjunction with the accompanying drawing wherein:

The single FIGURE is a perspective view of a carriage construction in accordance with the invention showing the escapement, tab and margin racks and associated control mechanisms located between carriage rails.

Referring to the FIGURE, there is shown a carriage generally designated by reference numeral 10 which is adapted to be drawn in carriage return direction or to the right indicated by arrow 11 in response to a pull on a draw cord secured to the carriage until a margin stop on the carriage hits a center stop causing disengagement of a carriage return clutch to terminate pull on the draw cord.

The carriage 10, as viewed in the FIGURE, has a transverse carriage beam generally designated 12 whose edges form rails 13 shaped complementary to rails 14 of a transverse carriage supporting beam 15 supported on a machine frame supported compound bracket 16 between which rails are roller elements 17. Mounted on the bracket 16 is a center stop structure 18. More particularly, the center stop structure 18 has rearwardly extending arms 21 secured to a bracket supported shaft 22. The lower rail defining machine frame supported bracket 16 also has downwardly extending arms 23 which pivotally support the shaft 22 outwardly of the center stop structure support arms 21, yet allow movement of the center stop structure a limited distance to the right from the normal position shown, which movement is used to provide line locking as more particularly shown in an application of Theodore N. Madison, Ser. No. 333,295, filed Feb. 16, 1973, titled Type Action Arrangement, now U.S. Pat. No. 3,838,762. A center stop 24 normally extends upwardly and lies in the path of margin stops 25 settable along a margin rack 26.

A salient feature of the invention resides in that the carriage beam 12 supports on its underside the margin rack 26, a tab rack 27, and an escapement rack 28 between the carriage rails 14. This arrangement reduces the moment arms tending to rotate the carriage 10 about a vertical axis whenever the carriage 10 is arrested as when a margin stop 25 encounters the center stop 24 or a set tab stop 31 encounters a positioned set tab blade 32 or when an escapement pawl 33 or a backspace pawl 34 engages the escapement rack 28. This balanced construction reduces tendency to bind and jam and permits the carriage frame to be made from light sheet metal lessening its weight. The low mass balanced carriage construction permits the elimination of carriage arresting dash pots yet allows the carriage 10 to be fully returned to the left margin and placed again under control of the escapement with even margin assured.

As shown in the FIGURE, the escapement pawl 33 is pivoted on a stud 35 which extends from the machine frame bracket 16 and into a slot 36 in the pawl 33 of a length allowing an escapement. A tab release arm 37 of the pawl extends leftwardly of the pivot and a pawl return arm 38 extends downward below the pivot stud 35. An arm 41 extending rightward of the pivot stud is bent rearwardly and upwardly and terminates in a rack engaging tooth 42.

As disclosed in said parent application, an escapement function is accomplished by rocking the escapement pawl 33 clockwise about stud 35 against pawl restoring spring 43 to release the rack 28 for movement. Escapement movement of the carriage in the direction of arrow 44 occurs under control of a spring motor (not shown), as is conventional, and as disclosed in said parent application carries with it the released and reengaged pawl 33 to the other limit of the slot 36 to effect an escapement.

As disclosed in the parent application, the tabular blade 32 is powered upwardly into the path of set stops 31 when a link 45 is moved to the left. The forked end 46 of the link embraces a pin 47 extending from the depending arm 48 of a tab blade positioning lever 51 pivoted as at 52 on the machine frame. The arm 53 of the lever extending to the left as viewed in the FIGURE is connected by a tab blade return spring 54 to a link support bracket and its end has a center stop control projection (not shown) which serves to move the center stop 24 out of the path of margin stops 25 during tabulation. The lever arm 53 also has a pin 59 extending therefrom which serves to raise an escapement release lever 60 against the tail 37 of the escapement pawl 33 to release the escapement pawl during tabulation. The tabular blade 32 is pivoted on the end of lever arm 53 and extends upwardly, its terminal end 55 serving, when positioned, to be engaged by a set tab stop 31 and arrest tabulating carriage movement indicated to be in the direction of arrow 44. The tab stop blade near its terminal end is provided with an overhanging edge 56 which, when the blade is raised, latches over a finger 57 extending from a latch plate. A tabulating movement of the carriage in the direction of arrow 44 will bring a set tab stop 31 against the positioned and latched tab blade 32, rocking tab blade 32 counterclockwise about its pivot on lever 53 releasing it from the latch finger 57 to allow spring 54 to return the tab blade 32 downward, thus allowing the escapement to reengage the escapement rack and arrest carriage movement.

The above compact construction with all racks and control elements located between carriage rails thus minimizes twisting moments.

What is claimed is:

1. In a typewriter having a frame and a carriage mounted for movement relative to said frame, a rail mounted on said frame, a complementary shaped rail mounted on said carriage forming with said frame mounted rail bearing channels, said carriage mounted rail having mounted thereon in closely spaced relationship an escapement rack, a margin rack and a tab rack, said escapement rack, margin rack and tab rack being located between said bearing channels and between said frame and carriage mounted rails, and said frame mounted rail having openings between bearing channels to accommodate escapement and backspace pawls for engagement with said escapement rack, a tab blade for engagement with set stops on said tab rack and a center stop for engagement with margin stops on said margin rack.

2. In a typewriter as recited in claim 1, said carriage rail being formed of light sheet metal.

3. In a typewriter as recited in claim 1, said tab rack being located between said margin and escapement racks.

* * * * *